US006241531B1

(12) United States Patent
Roath et al.

(10) Patent No.: US 6,241,531 B1
(45) Date of Patent: Jun. 5, 2001

(54) COMPRESSION INTERCONNECT SYSTEM FOR STACKED CIRCUIT BOARDS AND METHOD

(75) Inventors: Alan L. Roath, Madison; John T. Venaleck, Painesville, both of OH (US)

(73) Assignee: Ohio Associated Enterprises, Inc., Painesville, OH (US)

( * ) Notice: Subject to any disclaimer, the term of this patent is extended or adjusted under 35 U.S.C. 154(b) by 0 days.

(21) Appl. No.: 09/466,381

(22) Filed: Dec. 17, 1999

Related U.S. Application Data

(60) Provisional application No. 60/112,956, filed on Dec. 18, 1998.

(51) Int. Cl.[7] ..... H01R 12/00
(52) U.S. Cl. ..... 439/66; 439/591
(58) Field of Search ..... 439/66, 91, 591, 439/69, 74, 81, 608

(56) References Cited

U.S. PATENT DOCUMENTS

| | | | | |
|---|---|---|---|---|
| 4,420,215 | | 12/1983 | Tengler | 429/723 |
| 4,505,529 | * | 3/1985 | Barkus | 439/66 |
| 5,169,320 | * | 12/1992 | Burkett, Jr. et al. | 439/66 |
| 5,899,755 | * | 5/1999 | Kline | 439/66 |

* cited by examiner

*Primary Examiner*—Khiem Nguyen
*Assistant Examiner*—Son V. Nguyen

(74) *Attorney, Agent, or Firm*—Renner, Otto, Boisselle & Sklar, LLP

(57) ABSTRACT

An interface connector and method of connection provides balanced resilient contact force of sufficient magnitude for maintaining secure electrical connections between stacked circuit boards in high stress conditions, for example, at high acceleration, using a feed through connection while substantially minimizing size requirements. The interface connector includes a connector housing having a perimeter for fitting within such form factor and a pair of opposite substantially planar surface areas for confronting circuit boards in stacked relation thereto, openings through the connector housing in alignment with terminal pads on respective circuit boards, and electrical contacts in the openings; the electrical contacts connecting terminal pads of one circuit board to terminal pads of the other circuit board; the electrical contacts including a spline in an opening of the connector housing, a pair of contact arms extending from opposite ends of the spline and having respective contact areas ordinarily exposed from a respective opening beyond a respective planar surface of the connector housing when the contact arms are in free unconstrained relation, the contact areas of an electrical contact being compressed toward such planar surfaces and openings by engagement with terminal pads of respective circuit boards adjacent the connector housing, and the spline including a non-linear portion that bends toward engagement with a wall in the opening in response to moment caused by such compressing. A distributed, ground plane may be selectively connectable to respective contacts and my be used for electromagnetic interference (emi) shielding.

21 Claims, 4 Drawing Sheets

COMPRESSION INTERCONNECT SYSTEM FOR STACKED CIRCUIT BOARDS AND METHOD

This application claims priority under 35 USC 119(e) of provisional U.S. patent application No. 60/112,956, filed Dec. 18, 1998.

TECHNICAL FIELD

The present invention relates generally, as indicated, to a compression interconnect system for stacked circuit boards and, more particularly, to a feed through connector and method for connecting plural circuit boards in stacked relation. The invention may be used in a high stress, high vibration, and high mechanical shock environments, as well as in other environments, devices, and systems.

BACKGROUND

As electronic systems become more complex, more compact, and more widely used and relied on, the integrity and reliability of electrical connections between various electrical parts, such as circuit boards carrying electronic components, increases in importance. Circuit boards with electronic components, such as integrated circuits, printed circuit traces, and/or other devices thereon, therein and/or otherwise associated therewith can be manufactured in a controlled environment for quality assurance and at the manufacturing level they can be carefully tested to confirm acceptable operation within specifications. However, as the number of connections of the electronic components increase per area of the circuit board, it becomes more difficult properly to align connection devices, to maintain connections and to test and to examine the connections and the overall electronic systems as they are assembled and used.

Also, as more electronic devices are used in mechanical systems and are subjected to space constraints of those mechanical systems and to mechanical forces and stresses during expected use of the mechanical systems, the difficulty in maintaining integrity of electrical connections increases. The failure of an electrical connection may result in failure of part or all of the mechanical system.

An exemplary mechanical system in which electronics are used, for example, for guidance, communications, munitions operations (e.g., firing), etc., are missiles. The electronics are provided on a plurality of circuit boards, each of which has one or more electronic components, printed circuits, terminal pads, etc. thereon, and the circuit boards are arranged in a stacked or sandwich relation to fit the form factor dictated by the missile shape, for example, a generally hollow cylindrical shape. Several circuit boards may be used to provide adequate area (sometimes referred to as board real estate) for the various electrical and electronic components required for the electronics and the electrical functions for the missile. Feed through connector devices are placed between otherwise adjacent circuit boards to connect electrically the respective circuits thereof to carry out intended functions. Missiles and like devices, such as torpedoes, rockets and other similar devices, undergo high stresses and accelerations during use, and it is difficult, but nevertheless important, to maintain the integrity of electrical connections in the electronics thereof for proper guidance, communications, munitions operations, etc. to avoid failures which may be not only expensive but also potentially catastrophic. Machines, portable electrical and electronic devices, for example, portable computers, and the like also need reliable electrical interconnects able to withstand normal and sometimes abusive conditions of mechanical forces.

A prior technique to interconnect circuits of stacked circuit boards in missiles, for example, has used a ball grid array of terminals on the respective circuit boards and an interface connector between the circuit boards. The interface connector includes an electrically nonconductive housing with through openings aligned generally with a respective ball contact on each of the adjacent circuit boards and with electrically conductive wool-like material, such as gold plated copper wool (of a form and texture similar to steel wool) in the openings providing a plurality of relatively light touch, small point connections with the ball terminals. Sometimes such conductive wool is referred to as fuzz buttons. There are a number of disadvantages to such a prior interconnect system. For example, the ball terminals must be soldered into respective concave terminal recesses in the circuit board; this is labor intensive (expensive), and it is possible for the solder connection to break under the stress of missile acceleration, thus causing a failure mode of the device. Breakage of a solder connection also is possible when the ball is not correctly aligned with the contact or pad to which it is intended for connection, thus resulting in a shear stress applied to the ball and or solder connection tending to break the connection. Another disadvantage is that acceleration may compress the wool-like material causing it to move away from the "up stream" ball terminal resulting in an open circuit failure. The manufacturing of the ball grid array of terminals of the circuit board, including the soldering of the balls in respective concave recesses without short circuits in a compact, relatively dense arrangement of such terminals, may be a difficult and time consuming task.

Thus, it will be appreciated that there is a need for a facile, robust and reliable interconnection mechanism for making feed through connections of circuits of stacked circuit boards or the like, especially for use in high stress environments, such as missiles, rockets and the like.

The need for electromagnetic interference (emi) shielding in many electronic devices is well known. Shielding between generally planar stacked devices and/or levels in a multilevel circuit board sometimes is provided by a conductive ground plane. Sometimes a case, e.g., an electrically conductive case, has been used to provide lateral shielding. Such shielding systems have been somewhat cumbersome, costly and space consuming. It would be desirable to facilitate such shielding and provision of ground connections in an electrical connector system and to provide easy selectability of such ground connections.

SUMMARY

With the foregoing in mind, then, an aspect of the invention is to interconnect circuits of stacked printed circuit boards using an interface connector and method providing reliability and accuracy of electrical connections.

Another aspect is to provide balanced resilient contact force of sufficient magnitude for maintaining secure electrical connections between stacked circuit boards using a feed through connector while substantially minimizing size and space requirements.

Another aspect is to provide such electrical interface connection in the electronics of a missile, rocket or the like.

A further aspect is to minimize travel of a contact area of a resilient contact as the contact is compressed or deformed during connection with another device, such as a terminal pad, thereby minimizing size requirements for the terminal pads while allowing some wiping action of the terminal pads for good electrical connection.

Another aspect is to make a strong, reliable direct connection to terminal pads of circuit boards by contacts of a through connector.

Even another aspect is to balance the contact forces of a feed through contact and to maintain the contact forces substantially uniform for feed through contacts of a compression interconnect system.

Yet another aspect is to protect the contacts of a compression interconnect system from mechanical overload or over stress which maintains reliability of connections and substantial uniformity of contact force.

Another aspect relates to a versatile ground connection for an electrical connector.

Another aspect is a method to provide versatile ground connections for an interface connector.

Another aspect is to provide planar and side/lateral emi shielding for a connector.

Another aspect relates to a high density precision interconnection device, including a plurality of electrical contacts, and a non-conductive support housing, each of the contacts including a deformable non-linear retainer retaining the contact with respect to the support housing, and including a portion in spaced apart relation facing the support housing, a contact point engageable with an electrically conductive member for electrical connection therewith, a support arm supporting the contact point from the retainer and cooperative to deform the retainer causing the retainer portion to engage the support housing as the contact point and an electrically conductive member engage while substantially minimizing relative movement between the contact point and the electrically conductive member.

Another aspect relates to an interface connection apparatus for making connection between plural conductive members, including a support surface, plural contact portions, each on a respective support arm, a bowed spring-like support facing the support surface, the spring-like support having a deformable portion which in a relatively un-stressed condition is in spaced-apart relation to the support surface, the support arms extending from respective ends of the spring-like support, and the contact portions and support arms being cooperative with the spring-like support upon movement of the contact portions toward each other and relative to the spring-like support thereby resiliently urging the spring-like support toward the support surface.

Another aspect relates to an interconnect apparatus for connecting terminals on respective circuit boards or the like, including a nonconductive housing, plural openings in the housing aligned with respective terminals of respective circuit boards or the like, plural contacts positioned in respective openings, the contacts comprising, a resiliently deformable leaf spring facing a wall of an opening and having a part that absent deformation is in spaced apart relation to the wall, contact arms extending from opposite parts of the leaf spring and including contact areas for engaging respective terminals, the contact arms being movable toward each other to apply moment in the leaf spring resiliently deforming the leaf spring and urging the part toward the wall in response to compression force applied by respective terminals to opposite contact areas of the contact.

Another aspect relates to a compression interface connection assembly, including a connector body having openings for alignment with terminals on circuit boards at opposite sides of the connector body arranged in sandwiched relation, contacts in respective openings for electrically connecting terminals of one circuit board with respective terminals of the other circuit board, the contacts comprising a one piece leaf spring construction including, a bow portion aligned with and facing a wall of the connector body, and contact arms extending from the bow portion generally in parallel with each other, and the contact arms including contacting area for engaging respective terminals, the contact arms extending at an angle with respect to the bow portion to apply a moment thereto when the contact arms are compressed and urged toward each other by the circuit boards, and wherein substantially the entire length of the bow portion is used to sustain the moment of the contact load.

Another aspect relates to a compression interface connection assembly, including a connector body having openings for alignment with terminals on circuit boards at opposite sides of the connector body arranged in sandwiched relation, contacts in respective openings for electrically connecting terminals of one circuit board with respective terminals of the other circuit board, the contacts comprising a one piece leaf spring construction including, a bow portion aligned with and facing a wall of the connector body, and contact arms extending from the bow portion generally in parallel with each other, and the contact arms including contacting area for engaging respective terminals, the contact arms extending at an angle with respect to the bow portion to apply a moment thereto when the contact arms are compressed and urged toward each other by the circuit boards, and wherein the wall limits deflection of the bow portion.

Another aspect relates to a stacked arrangement of electrically interconnected circuits, including a connector housing, contacts carried by the connector housing, respective circuits at opposite sides of the connector housing in stacked relation and interconnected electrically with and via respective contacts, the contacts comprising leaf spring contacts having respective contact areas resiliently urged into connecting engagement with terminals of respective circuits and a flexible bowed portion in the connector housing for deflecting in response to moment imparted thereto by movement of the contact areas compressed toward each other by the circuits engaged with the contact areas.

Another aspect relates to a method of electrically interconnecting a plurality of circuit boards in stacked relation, including urging a pair of circuit boards toward opposite sides of a connector housing in stacked relation therewith to compress contact areas of respective leaf spring contacts carried by the connector housing toward each other causing resilient engagement of the contact areas with respective terminals of the circuit boards while moment created by the resilient engagement is sustained by a portion of the contact in the connector housing.

Another aspect relates to a feed-through connector system to interconnect stacked circuit boards arranged in an elongate form factor, such as a missile or the like, including a connector housing having a perimeter for fitting within such form factor and a pair of opposite substantially planar surface areas for confronting circuit boards in stacked relation thereto, openings through the connector housing in alignment with terminal pads on respective circuit boards, electrical contacts in the openings, the electrical contacts connecting terminal pads of one circuit board to terminal pads of the other circuit board, the electrical contacts including, a spline in an opening of the connector housing, a pair of contact arms extending from opposite ends of the spline and having respective contact areas ordinarily exposed from a respective opening beyond a respective planar surface of the connector housing when the contact arms are in free unconstrained relation, the contact areas of an electrical contact being compressed toward such planar surfaces and openings by engagement with terminal pads of respective circuit boards adjacent the connector housing, and wherein the spline includes a non-linear portion that bends toward engagement with a wall in the opening in response to moment caused by such compressing.

Another aspect relates to a method of providing selective grounding and/or shielding in an interface connector including a planar conductive member in a connector housing, conductive tabs from the conductive member extending into respective openings in the housing, and deformable contacts in respective openings, comprising deforming at least one contact upon engagement with an external member intended to be connected to such contact so as to urge a portion of the contact into engagement with the conductive member.

Another aspect is a versatile selectable ground plane connection mechanism for an interface connector or other electrical connector.

Another aspect is to provide lateral emi shielding for an interface connector or other electrical connector.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

Although the invention is shown and described with respect to one or more preferred embodiments, it is to be understood that equivalents and modifications will occur to others skilled in the art upon the reading and understanding of the specification. The present invention includes all such equivalents and modifications, and is limited only by the scope of the claims.

DESCRIPTION

Figure 1:
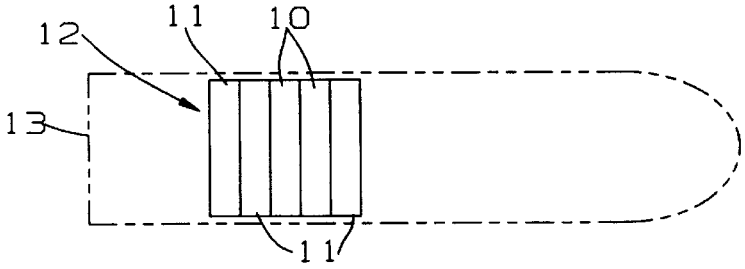
FIG. 1 is a schematic illustration of an electronics stack including interface connectors of the present invention used in a missile.

FIG. 1 is a schematic illustration of several interface connectors 10 interconnecting plural circuit boards 11 in an electronics stack 12 used, for example, for guidance, communications, munitions operation (e.g., firing), etc., in a mechanical device 13, such as a missile. The invention is described here relative to use in a missile, but it will be appreciated that the invention may be used to provide electrical interconnection between stacked circuit boards in other environments, such as torpedoes, rockets, aircraft, automotive vehicles, boats, portable and non-portable equipment, computers, and other places where an electronics stack, such as that shown at 12, maybe used.

As is described in further detail below, the interface connector 10 is robust and is especially useful to maintain integrity of electrical connections made thereby, even under relatively stressful conditions, such as those caused by high acceleration, mechanical shock, or the like. The interface connector 10 easily can be made to meet form factor requirements of the interconnected circuit boards 11 and the space constraints of the mechanical device 13. Although two interface connectors 10 are shown to interconnect three circuit boards 11 in the electronics stack 12, such illustration is exemplary; it will be appreciated that the electronics stack 12 may include more or fewer of such interface connectors and circuit boards as may be required in the mechanical device 13.

Figure 2:
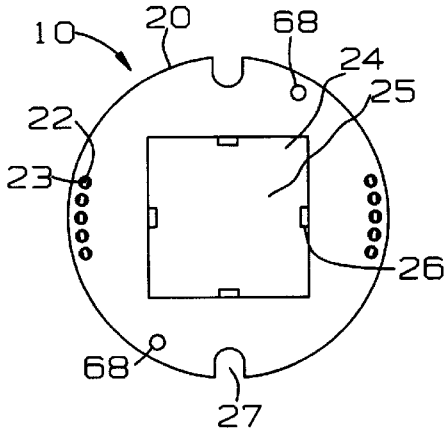
FIG. 2 is a schematic plan view of a connector housing for an interface connector of in accordance with the invention.

Briefly turning to FIG. 2, a front plan view of an embodiment of the interface connector 10 is illustrated. The interface connector 10 includes a connector housing 20 that has a contacts portion 21 with a plurality of openings 22 in which electrical contacts 23 (also referred to as terminals, etc. in the art) are positioned. To simplify the illustration of FIG. 2, only several contacts 23 are shown, but it will be appreciated that electrical contacts may be in many other, and, if desired, all, of the openings 22. Also, the number of openings 22 may be more or fewer than those shown in the drawings and the pattern or position thereof may be different than that shown. The connector housing also has a space 24 in which electronic components of respective circuit boards 11 may protrude above or below the surface of a respective circuit board. If desired, an electrically nonconductive spacer 25 may be mounted in the space 24 on tabs 26 formed in the connector housing 20 to separate the electronic components of relatively adjacent circuit boards 11. Alternatively, the spacer 25 may be electrically conductive to provide an electromagnetic shielding function.

As is shown in FIG. 2, the contacts portion 21 of the connector housing 20 generally is in the area near the outer perimeter of the connector housing relative to the more central space 24. However, the contacts portion 21 may include portions that are located in the space 24 or, as another alternative, the contacts portion 21 may be relatively centrally located in the connector housing 20 and the space 24 provided proximate the outer perimeter. The relative locations of the contacts portion 21 and the space 24 may be easily designed to meet the design of the circuit boards 11 being interconnected. Several alignment slots or openings 27 may be provided in the connector housing 20 to accommodate alignment or mounting bars, ribs or the like to hold the interface connector(s) 10 and circuit boards 11 in the electronics stack 12 appropriately aligned with each other, interconnected with each other, and/or securely positioned in the mechanical device 13.

Figure 3:
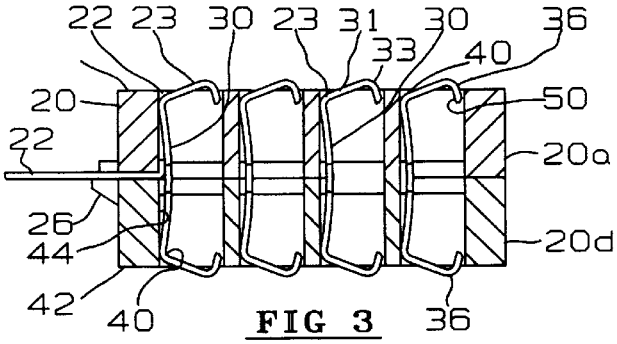
FIGS. 3 and 4 are fragmentary views, partly in section, from the edge and from the front of several contacts in a connector housing of an interface connector in free, unstressed, unloaded condition.
Figure 4:
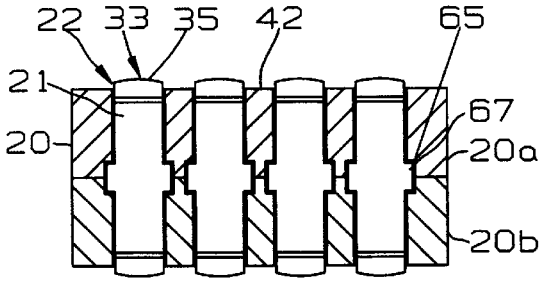
Figure 5:
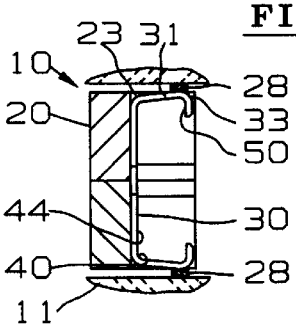
FIG. 5 is a fragmentary section view, partly in section, similar to FIG. 3, of an interface connector showing a contact in stressed, loaded operational condition in an electronics stack.

Turning to FIGS. 3–5, a plurality of electrical contacts 23 and openings 22 of a connector housing 20 of the interface connector 10 are illustrated schematically. In FIGS. 3 and 4 the contacts 23 are in free, unstressed, unloaded condition not connected to respective circuit boards 11. Four contacts 23 are shown in each of FIGS. 3 and 4, it being appreciated that such arrangement of four contacts may be taken from any of various locations in the interface connector 10 as depicted in FIG. 2 where there are four contacts in relatively adjacent openings 22. In FIG. 5 a contact 23 is shown in stressed, loaded condition providing electrical connection between terminal pads 28 of respective circuit boards 11. Connections of contacts 23 can be made directly to the terminal pads which improves reliability of connections since intermediate devices, such as ball terminals of a ball grid array, are unnecessary.

Each contact 23 has characteristics of a leaf spring and may be referred to below as a leaf spring contact or leaf contact. The leaf spring contact 23 includes a non-linear spline or central support 30 and a pair of contact arms 31 at respective opposite ends of the spline. The contacts 23 are symmetrical so the following description uses the same reference numerals for corresponding parts of the contacts at the top and bottom thereof (top and bottom being for convenience of reference to the drawings, but are not directional requirements for the interface connector 10 during use thereof). The symmetrical configuration of the contacts also helps maintain balanced equal forces at both ends of the contacts as is described herein.

During use of the interface connector to connect terminal pads 28 of respective circuit boards 11, the contact arms 31 of contacts 23 are compressed toward each other creating moments which are sustained by the spline 30, and the spline tends to flatten or straightens out against a wall in the opening 22. Compression force may be applied by bolting the circuit boards 11 and the interface connectors 10 together in the electronics stack 12 (FIG. 1). The compression force is opposed by the spring force of the contact arms, which is due to resilient bending of the contact arms and the resilient flattening of the spline 30, and such spring force is the contact force with which contact areas 33 of the contact arms engage respective terminal pads 28. The spring force is the result of the spring constant associated with the contact arms 31, their connections to the spline 30, the spring constant associated with the leaf spring characteristics of the spline, and the distances of movement of the parts of the contact 23 as the contact is compressed from unstressed (unloaded) condition to stressed (loaded) condition described herein. Such operation minimizes lateral movement of the contact arms across a terminal pad 28 on a circuit board 11. Also, deflection of the contacts 23 is self-limiting in that over stressing or over deflection of the contact arms is limited by the connector housing 20; for example, if the surfaces of the connector housing 20 and the circuit, circuit board or terminal pad to which connection is being made are flat, then deflection of the contact arms 31 stops at the connector body. The contact forces exerted against the terminal pads 28 by both contact arms 31 of the contacts 23 are substantially balanced, uniform and secure, even in the presence of forces occurring during high acceleration and are sufficient to maintain connection with terminal pads during such acceleration conditions. Exemplary spring force may be, for example, on the order of from about 70 grams to about 100 grams per contact connection to a terminal pad 28. Flattening action of the spline 30 controls the location of and manner of bending of the contact and movement of the contact areas 33 to minimize movement of the contact areas along the terminal pads; this in contrast to the larger movement expected to occur in the event the spline were straight-unbowed.

The contact areas 33 of contact arms 31 engage respective terminal pads 28 of respective circuit boards 11. Typically such terminal pads 28 may be relatively flat, smooth conventional terminal pads typically used for connections solder type or other connections on the surface of a respective circuit board 11. If desired, each of the contact areas or contact portions 33 may be crowned, dimpled or curved across the width of the contact arm 31 (the width dimension illustrated in FIG. 4) by a metal forming operation, such as stamping or punch process (or by some other process) to define a contact point 35 (seen in FIG. 4) for making precise engagement with circuit board terminal pads 28 and for concentrating the force of such engagement. The contact areas 33 also are curved at the contact point 35 in the length direction of the contact arm 31, as seen in FIG. 3, where the distal end 36, which is relatively remote from the spline 30, is bent or curves toward the opening 22. Such curvatures in the area of the contact point 35 provide a relatively high Hertzian stress contact point. The contact point 35 may be a specified point or may be actually several points, areas or portions of the contact areas 33 which actually engage a terminal pad for connection therewith.

The contact arms 31 extend from the spline 30 somewhat in cantilever fashion at respective bends 40. Prior to placement and interconnection with circuit boards 11, tile contact arms 31 extend from the bends 40 to place the contact areas 33 outside the openings 22 above or below the substantially planar surfaces 42 of the connector housing 20. However in use of in the electronics stack 12, the interface connector 10 is sandwiched closely with circuit boards 11 which face or confront and which possibly engage the respective surfaces 42, and the terminal pads 28 of the circuit boards engage the contact areas 33 bending and, thus, compressing the contact areas and the contact arms 31 of respective contacts 23 toward each other to the condition illustrated schematically in FIG. 5.

As is illustrated in FIG. 5, when engaged with terminal pads 28 of circuit boards 11, the contact arms 31 and the contact areas 33 are pushed toward the openings 22 and become partly or fully recessed in respective openings below the plane of the connector housing surface 42. The compressive force of the circuit boards against the contact arms 31 causes the nonlinear (e.g., not straight) spline 30, which preferably is curved or bowed generally in the manner illustrated in FIG. 3, to bend as a leaf spring bends, to move toward the wall 44 of the connector housing 20 bounding at least part of the opening 22. Maximum bending movement of the spline 30 is limited by the wall 44 as is illustrated in FIG. 5.

During the compressing of the contact arms 31, moments are created in the contact 23, and the moments of such loading or compressing is sustained over substantially the entire length of the spline 30, thus providing a substantially uniform distribution of moments and forces over substantially the entire length of the spline 30 avoiding points of excessive stress and potential damage. Further, maximum deflection of the contact arms 31 is limited by the surfaces 42 to avoid over stressing of the contact arms beyond elastic limit. The tip 50 of each contact arm 31 preferably is bent so that the distal end of each always remains within the opening 22 even when the contact 23 is in free unstressed condition not sandwiched between a pair of circuit boards 11. This arrangement helps protect the contact arms, avoiding the possibility of a snag in the event of a slight lateral motion or other force tending to distort or to deform the contact arms and causing them to hang up on or to engage a surface 42 during assembly with circuit boards 11 in an electronics stack 12.

The crowns 35 isolate the point of contact with a terminal pad 28 point to a specific point as opposed to a random point on a line, for example, assuring accurate engagement with a particular terminal pad on a circuit board. The crowns also provide relatively uniform high force concentration or contact force between the contacts and respective terminal pads.

Figure 6:
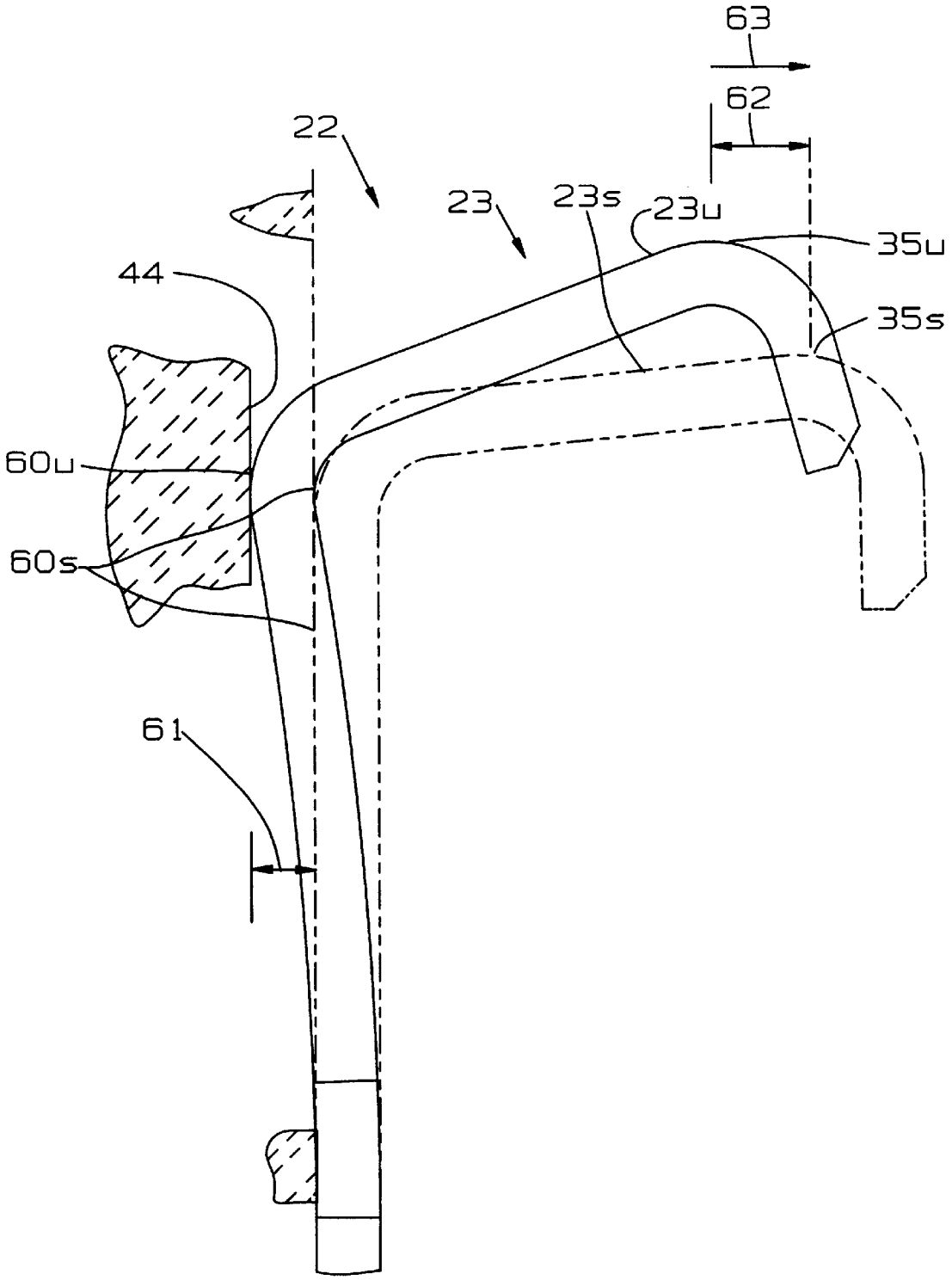
FIG. 6 is a schematic illustration of an electrical contact of the interface connector showing a comparison of the unstressed/unloaded and stressed/loaded conditions thereof.
Figure 11:
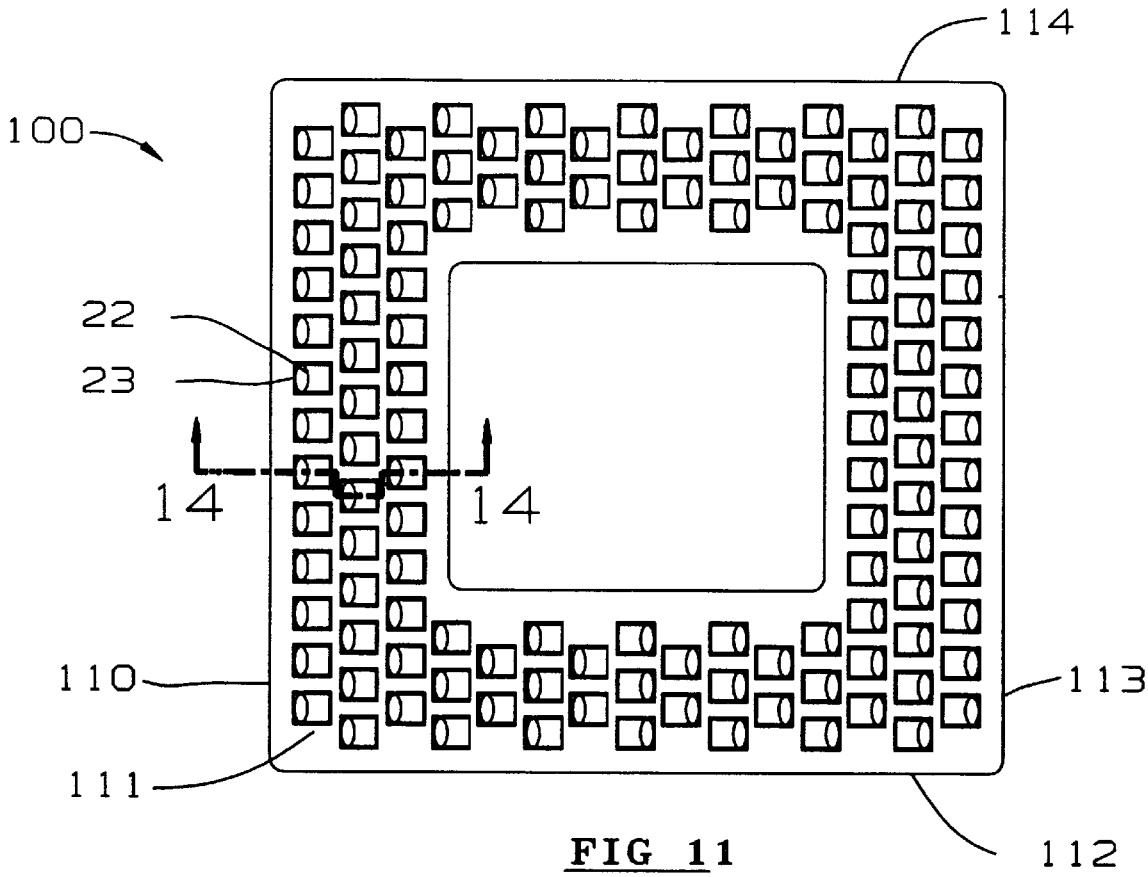
FIG. 11 is a plan view an interface connector including a ground member.
Figure 7:
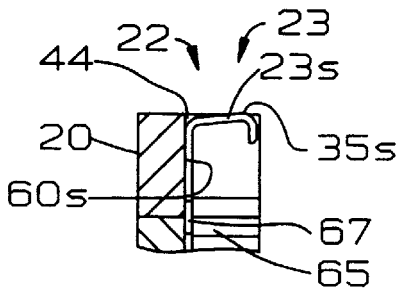
FIGS. 7 and 8 are schematic side elevation views similar to FIG. 6 showing an electrical contact of the interface connector respectively in stressed/loaded condition and unstressed/unloaded condition similar to the showing in FIG. 6.
Figure 8:
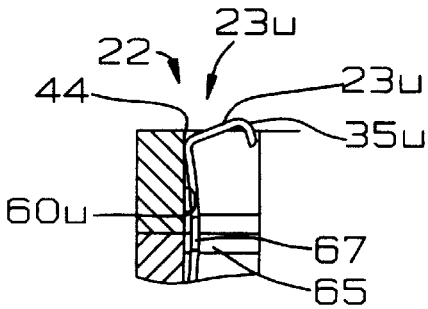

In FIG. 6 is a schematic illustration of the upper half of a contact 23 relative to the connector housing opening wall 44. The contact is designated 23*u* as shown in solid lines in free unstressed unloaded condition, as in FIGS. 3 and 4, and is designated 23*s* as shown in hatched lines in stressed loaded condition, as in FIG. 5. The alphabet characters "u", "s" represent, respectively, unstressed (unloaded) and stressed (loaded) conditions of the contact 23, the latter being the case when the interface connector 10 is in operative use in an electronics stack 12, for example, with the contact points 35 engaged with respective terminal pads 28. The locations 60*u*, 60*s* designate the place where the upper (or symmetrically lower) end of the spline 30 engages the connector housing wall 44*u*, 44*s* in an opening 22. The housing wall 44 is shown schematically at two locations 44*u*, 44*s* separated in the drawing by the distance 61 to represent the relationship of the wall 44 with the contact 23 respectively in the unstressed and stressed states shown at 23*u* and 23*s* . The distance 62 shown in FIG. 6 minus the distance 61 represents the relatively small amount of lateral movement of the contact point 35 (shown at 35*u* and 35*s*), e.g., across a terminal pad 28, as the contact 23 is stressed from unloaded to loaded condition. The small amount of lateral movement in the direction of the arrow 63 provides some degree of wiping action against the terminal pad 28 of a circuit board 11 to help assure good quality electrical connection therewith. In some instances, for example, a wiping of the contact 23 against a terminal pad 28 by an amount of about 0.002 inch to about 0.005 inch is acceptable to remove oxide and debris to provide relatively clean mating surface connection. Preferably the contact point 35 remains engaged with the surface of a terminal pad from the point it first engages the terminal pad during assembling the electronics stack 12 until the electronics stack is fully assembled; this avoids unnecessary wear that may occur if the contact point has to move or to step up from the surface of a circuit board 11 to the surface of the terminal pad. By substantially minimizing the amount of such movement in the direction of the arrow 63, the terminal pad 28 can be relatively minimal size while still assuring that the contact point 35 remains on the surface of and engaged with the terminal pad upon initial engagement and while loaded. Also, since the contact point 35 engages a terminal pad 28 that is a land, it is unlikely that even in the event of a small misalignment any stresses would occur that would break a solder connection, contrary to such problems encountered using ball grid array connections. Therefore, the connector of the invention has improved position tolerance, robustness and reliability over such prior ball grid array connectors.

During assembling of the electronics stack 12, a load placed on the contacts 23 as the contact arms 31 are urged toward each other imparts a moment in the area of the bend 40 which causes the bowed back or spline 30 of the contact to straighten out and to move back in its cell or opening 22 toward the wall 44. Such operation of the contact 23 not only helps to assure balance of contact forces at both contact arms but also minimizes the travel of the contact points 35 against terminal pads 28 of the circuit boards 11, thus minimizing wearing of those terminal pads, allowing those terminal pads to be of relatively minimal size needed to accommodate the limited travel or relative travel of the contact points 35, and still providing some movement or wiping between the contact points and the terminal pads 28 for good electrical connection. This feature permits a relatively high density packing of the terminal pads and contacts.

The interface connector 10 can be made relatively conveniently by molding or otherwise forming the connector housing 20 in two parts 20*a*, 20*b* (FIGS. 3 and 4), leaving a small gap, recess or pocket area 65 at each opening 22 adjacent the confronting surfaces 66. The contacts 23 may be formed made by metal forming, such as stamping or punch process, to have a configuration generally along the lines illustrated in FIGS. 3 and 4. Preferably the contacts 23 have tabs 67 (sometimes referred to in the art as tangs), which are held securely in the recesses 65 to retain the contacts in the respective openings 22 when the connector housing parts 20*a*, 20*b* are assembled in the manner illustrated in FIGS. 3 and 4. The contacts 23 can be loaded into one of the housing parts 20*b*, for example, and the housing part 20*a*subsequently can be placed in position directly over the housing portion 20*b* thereby to retain the contacts in the manner illustrated in FIGS. 3 and 4. Openings 68 (FIG. 2) are provided for riveting, heat staking or otherwise to secure the two housing parts 20*a*, 20*b* together.

In an exemplary embodiment of the invention, the connector housing 20 is made of liquid crystal polymer which is electrically nonconductive. The contacts 23 are made of copper alloy that is finished with gold plating over nickel. The height or thickness of the connector housing, e.g., the vertical direction as represented in FIG. 3, is about 0.110 inch. The spacing between contact points of adjacent contacts as viewed both in FIG. 3 and FIG. 4 may be from about 0.040 inch to about 0.050 inch (sometimes referred to as contacts on 0.040inch centers or 0.050 inch centers), and the approximate deflection of each of the respective contact arms may be approximately 0.006 inch. The dimple or crown contact point may be on the order of about 0.030 inch relative to a flat surface if the contact point 35 of the contact arm 33 were flat. These dimensions are exemplary and it will be appreciated that they and the interface connector 10 may be larger or smaller.

Figures 9, 10:
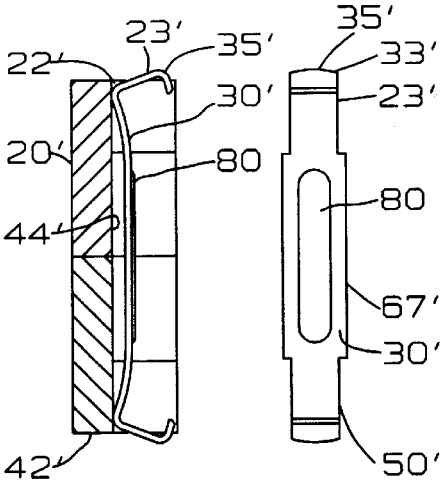
FIG. 9 is a fragmentary view of another embodiment of interface connector, such view being partly in section, from the edge of one contact in a connector housing in free, unstressed, unloaded condition.
FIG. 10 is a front elevation view of the contact shown in FIG. 9.

Briefly referring to FIGS. 9 and 10, where primed reference numerals represent parts that are the same or similar to those described above and designated by the same unprimed reference numerals, there is illustrated an alternate embodiment of interface connector 10', which is taller (thicker) than the interface connector 10. The interface connector 10' includes a connector housing 20' having openings 22' (one of which is illustrated) in which a contact 23' is positioned.

The contact 23' is substantially the same as the contact 23 described above except the length or height dimension of the contact 23' is greater than that of the contact 23. For example, the interface connector 10 of FIGS. 3 and 4 may be approximately 0.110 inch in height, whereas the interface connector 10' may be on the order of approximately 0.220 inch in height. The contact 23' includes a stiffening rib 80 to increase the stiffness of the spline 30' so the spring rate or spring constant of the contact 23' is substantially the same as the spring rate or spring constant of the contact 23. This allows interface connectors 10 and 10' to be used in the same electronics stack 12 while providing the same contact forces with respect to terminal pads to which the contacts 23 and 23' thereof are connected. The stiffening rib 80 may be formed by a metal punch process or some other metal forming process which upsets the metal of the contact 23' in the area of the spline 30' and work hardens the metal in the area of the stiffening rib 80. The stiffening rib 80 may be an additional piece of material, e.g., metal or some other material attached to the contact in the area of the spline 30, for example. The stiffening rib 80 may be somewhat resilient or flexible, or it may be relatively unyielding (e.g., does not bend) during ordinary operation of the contact 23' but rather moves toward and away from the wall 44', e.g., laterally relative to the drawing illustration, without bending or without substantial bending, e.g., as the connector 10' and contacts 23 thereof, e.g., is assembled or disassembled into or out of connection, such as in a stack 12, or other system.

Turning to FIGS. 11–15, an interface connector 100 is illustrated. The interface connector 100 includes a number of portions that are the same or similar to those portions described above with respect to the other drawing figures hereof. The interface connector 100 may be used in a manner similar to or the same as was described above. Therefore, parts of the interface connector 100 which are the same or similar to those described above may be identified by the same reference numerals used above with respect to the other drawing figures.

The interface connector 100, however, includes a ground member 101 which is positioned in sandwiched relation between the two portions 20*a*, 20*b* of the connector housing 20. The connector housing portions 20*a*, 20*b* may include appropriate recesses to receive the ground member 101 therein, for example, such recesses being shown at 102*a*, 102*b*. Such recesses may made as part of the manufacturing process for the portions of the connector housings 20, such as for example, plastic injection molding process or some other process.

The ground member 101 may be an electrically conductive member, such as a metal sheet. It may be made of some other material which has electrical conducting properties. The ground member 101 has a plurality of openings or cutouts therein. The remainder of the ground member may be a solid sheet of material. If desired, the ground member 101 may be a screen-like material such as, for example, something like a conventional window screen, but having a suitable mesh size and suitable electrical conducting characteristics to provide the desired grounding function described herein. The size of the openings 103 preferably is suitable to avoid interfering with the electrical contacts 23 in the respective openings 22 of the connector housing 20. For example, the actual dimensions of the openings 103 may be such that the material of the ground member 101 ordinarily does not enter or extend into the openings 22 unless intended to do so to make a ground connection to a respective contact 23 in such opening. Alternatively, the shape of the openings 103 may be different, provided the shape is suitable to avoid unintentional electrical connection with a respective contact 22.

Figure 12:
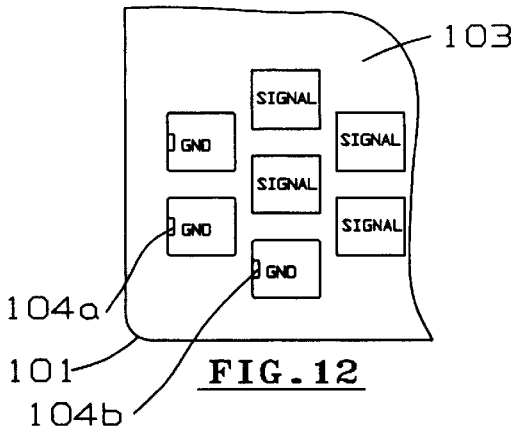
FIG. 12 is a plan view of a ground member useful in the interface connector of FIG. 11.

The ground member 101 includes one or more connection tabs 104. In FIG. 12 two of those tabs (one of which is identified by the reference numeral 104*a*) are bent out of the plane of the ground member 101 and one of the tabs 104*b* is shown in unbent relation, i.e., parallel to the major planar extent of the ground member 101. However, in use, the tab 104*b* would be bent out of the plane of the ground member 101, for example, to a perpendicular relation with respect thereto, in a manner similar to that shown for the tab 104*a*, for engagement with a respective contact 23, as now will be described.

Figure 13:
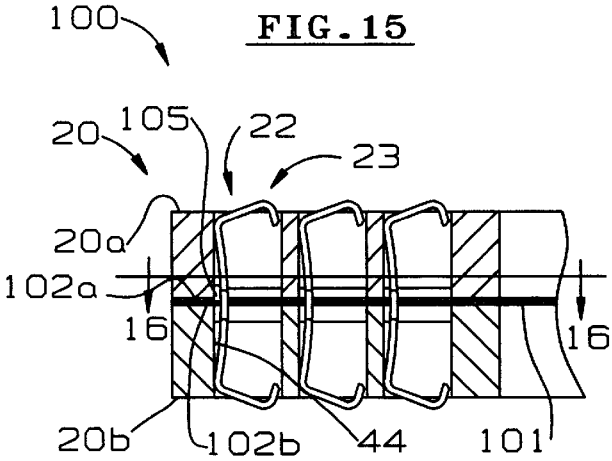
FIG. 13 is a section view of a portion of the interface connector of FIG. 11 looking generally in the direction of the arrows 13—13 of FIG. 11, the several contacts shown in FIG. 13 being in unstressed/unloaded condition.
Figure 14:
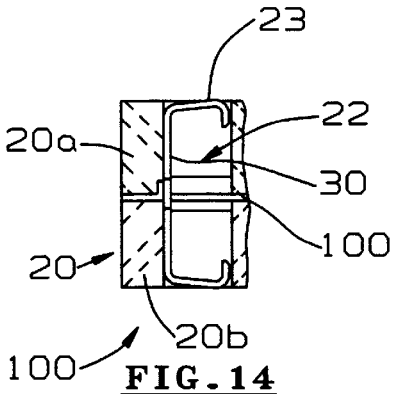
FIG. 14 is a partial section view similar to FIG. 13, but showing the contact in loaded/stressed condition.

For those contacts 23 intended to be connected to ground, a tab 104 of the ground member 101 is bent to an orientation illustrated in FIGS. 12–15. More specifically, the tabs 104 intended to connect with respective contacts are oriented to a location within an opening 22 so as to be connectable with a respective contact 23. In the illustrated embodiment, seen in FIGS. 13–15, the tab 104 does not engage a contact 23 unless and until the contact has been stressed or loaded to the condition illustrated in FIG. 14, for example, by engagement at both contact arms 31 and contact areas 33 thereof with terminal pads on a circuit board or other element intended to be connected by the interface connector 100. Such condition of the contact 23 as illustrated in FIG. 14. In FIG. 14 it can be seen that the tab 104 is engaged with the spline 30 of the contact 23 and, therefore, the contact 23 is connected to the ground member 101. It will be appreciated that although the ground member 101 preferable is at ground reference potential, it may be at some other potential, as may be desired.

In another embodiment, if desired, the tab 104 may be so positioned in the opening 22 as to be engaged with a respective contact 23 at all times, for example, engaging the spline 30 thereof. This arrangement, though, may be less preferred than that illustrated in the drawings, since in such case the tab 104 may interfere with the intended bending of the spline 30.

Figure 15:
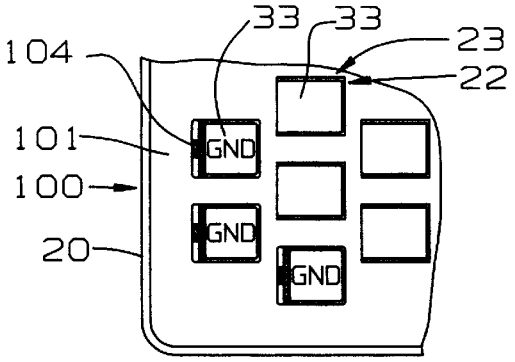
FIG. 15 is a top section view of the interface connector of FIG. 11 with the top connector half removed and looking generally in the direction of the arrows 15—15 of FIG. 13.

As is illustrated in FIGS. 13, 14 and 15, the housing portion 20*a* has a small recess 105 provided at respective openings (or, if desired, at all openings 22). In the embodiment illustrated in FIG. 14, the recess 105 is provided in the opening 22 in which there is a tab 104 and the contact 23 is intended to be connected to the tab and, thus, to the source of reference potential, e.g., ground. The recess 105 allows the tab to be recessed at least partly within the wall 44 of the connector body 20*a* to minimize the interference of the tab 104 with the intended bending of the spline 30 as the contact 23 is resiliently deformed or bent by force applied from a terminal pad, circuit, etc. with which the interface connector 100 is intended to make a connection.

From the foregoing, then it will appreciated that the interface connector 100 is quite versatile. It can be made so as to provide ground connections to any contacts 23 simply by forming the ground member 101 with respective tabs 104 and bending those tabs so they will be positioned to engage respective contacts 23 in the interface connector 100.

In addition to providing a ground reference connection, the ground member 101 may provide a shielding effect, particular providing shielding to block electromagnetic interference (emi) from one circuit to another circuit, which are located respectively at opposite surfaces of the interface connector 100 but which nevertheless are electrically connected by a respective contacts 23. Such emi shielding is provided to block a path for the emi from one circuit to another, the ground member 101 being positioned in that path and providing the blocking or shielding effect. Still further, if desired, the interface connector 100 with the ground member 101 may be configured such that the contacts 23 along one edge, such as edge 110 of the interface connector 100, e.g., the contacts in the row to which the arrow 111 points, all may be connected to ground member 101. Therefore, all of the contacts 23 in that row 111 along the edge 110 would be at ground reference potential, being connected to the ground member 101, so that they provide in effect lateral emi shielding. Even further, the contacts 23 along other edges, such as one or more other edges 112, 113, 114 of the interface connector 100, also may be connected to the ground member 101, thus providing emi shielding along those edges. Using a ground member 101 and contacts 23 to provide lateral shielding along all of the edges 110, 112, 113 and 114 and the ground member 101 to provide emi shielding between the circuits connected to opposite sides or surfaces of the interface connector 100, substantial emi shielding is obtained using the invention.

Figure 16:
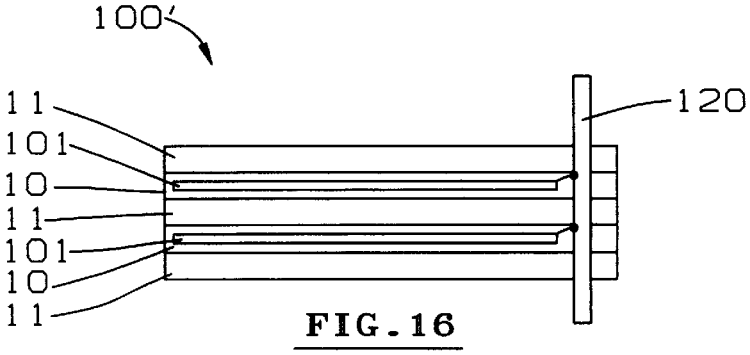
FIG. 16 is a schematic illustration of several interface a interface connectors and circuits connected thereby along with conductive rods to interconnect the grounds.

Another embodiment of interface connector 100' is shown in FIG. 16. The interface connector 100' is substantially the same as the interface connector 100, except that one or more electrically conductive rods 120 are included, such as those mentioned above for use in recesses 27, for holding together an interface connector 10 and circuits 11 at opposite surfaces thereof, e.g, as is shown in FIG. 1. The rods 120 may be electrically conductive and may connect electrically with the conductive member 101 of several interface connectors and/or with a part of the circuits 11.

In view of the foregoing, then, it will be appreciated that the interface connector of the invention may be used to provide reliable, robust interconnections between stacked circuit boards or other electronic devices.

What is claimed is:

1. A high density precision interconnection device, comprising;

a plurality of electrical contacts; and a non-conductive support housing, wherein each contact of the plurality of electrical contacts including:

a deformable nonlinear retainer retaining the contact with respect to the non-conductive support housing, the deformable nonlinear retainer including a retainer portion adjacent the non-conductive support housing, a contact portion electrical engageable with an electrically conductive member, and a support arm supporting the contact portion of the deformable nonlinear retainer and cooperative to deform the deformable nonlinear retainer causing the retainer portion to engage the support housing as the contact portion and the electrically conductive member engage to restrict relative movement between the contact portion and the electrically conductive member, and wherein compression of the deformable nonlinear retainer causes straightening of the retainer portion.

2. The device of claim 1, wherein the contact portion includes one or more points for making electrical contact.

3. The device of claim 1, further comprising an electrical connection to connect to a reference potential.

4. The device of claim 3, further comprising an electromagnetic interference shield, and the connection comprising a connection of at least one contact to the electromagnetic interference shield.

5. The device of claim 1, wherein the non-conductive support housing having plural openings in which respective contacts are located, the electrically conductive member having at least an electrically conductive member portion in the non-conductive support housing and extending over at least a projection portion of a projection of an area of the non-conductive support housing, openings in the electrically conductive member aligned with respective openings of the non-conductive support housing so as not to engage respective contacts in the openings of the non-conductive support housing, and at least one connection between the electrically conductive member for connection with a contact in a respective opening of the non-conductive support housing.

6. The device of claim 5, wherein the at least one connection includes a tab extending from the electrically conductive member.

7. The device of claim 6, wherein the electrically conductive member extending over substantially an entire plan area of the non-conductive support housing, and the openings in the non-conductive support housing and contacts including a plurality thereof along a perimeter of the non-conductive support housing and being connectable with the electrically conductive member to provide lateral shielding.

8. The device of claim 6, wherein the electrically conductive member includes a substantially planar member, and the tab extends at a non-parallel angle with respect to the substantially planar member to expose an opening of the non-conductive support housing for engaging with a contact in the opening.

9. The device of claim 8, wherein the non-conductive support housing includes a recess to contain at least a portion of the tab to minimize interfering with deformation of the retainer portion during the deformation of the support arms.

10. The device of claim 8, wherein the contact and the tab being disengaged when the contact is not loaded and in connection with external members; and the retainer portion of the contact engaging the tab upon deformation of the retainer during use of the device.

11. The device of claim 5, wherein the non-conductive support housing includes a recess for retaining the electrically conductive member.

12. An interface connection apparatus for making connection between plural conductive members, comprising;

a support surface, plural contact portions with each contact portion on a respective support arm, a bowed spring-like support adjacent the support surface, the bowed spring-like support having a deformable portion which in a relatively unstressed condition is in spaced-apart relation to the support surface, the support arms extending from respective ends of the bowed spring-like support, and the contact portions and support arms being cooperative with the bowed spring-like support upon movement of the contact portions toward each other and relative to the bowed spring-like support thereby resiliently urging the bowed spring-like support toward the support surface causing straightening of the bowed spring-like support.

13. An interconnect apparatus for connecting terminals, comprising;

a nonconductive housing, plural openings in the housing for alignment with respective terminals, and plural contacts positioned in respective openings, wherein each of the plural contacts includes:

a resiliently deformable spring facing a wall of an opening and having a part of the resiliently deformable spring spaced apart from the wall while the resiliently deformable spring is not deformed, contact arms extending from opposite ends of the resiliently deformable spring and including contact areas for engaging respective terminals, and the contact arms being movable toward each other by applying a compression force to the resiliently deformable spring at the contact areas thereby resiliently deforming the resiliently deformable spring and urging the part of the resiliently deformable spring toward the wall thereby causing straightening of the resiliently deformable spring.

14. The interconnect apparatus for connecting terminals of claim 13, wherein the spring is a leaf spring.

15. A compression interface connection assembly, comprising;

a connector body having openings for alignment with terminals on circuit boards at opposite sides of the connector body and arranged in a sandwiched relation, contacts in respective openings for electrically connecting terminals of one circuit board with respective terminals of another circuit board, the contacts comprising a one piece leaf spring construction including, a bow portion aligned with and facing a wall of the connector body, and contact arms extending from the bow portion substantially in parallel with each other, and the contact arms including a contacting area for engaging respective terminals, the contact arms extending at an angle with respect to the bow portion to apply a moment to the bow portion when the contact arms are compressed and urged toward each other by the circuit boards causing straightening of the bow portion, wherein substantially an entire length of the bow portion is used to sustain the moment of a contact load.

16. The assembly of claim 15, wherein the wall limits deflection of the bow portion.

17. A compression interface connection assembly, comprising;

a connector body having openings for alignment with terminals on circuit boards at opposite sides of the connector body arranged in a sandwiched relation, contacts in respective openings for electrically connecting terminals of one circuit board with respective terminals of another circuit board, the contacts comprising a one piece leaf spring construction including a bow portion aligned with and facing a wall of the connector body, and contact arms extending from the bow portion generally in parallel with each other, and the contact arms including contacting areas for engaging respective terminals, the contact arms extending at an angle with respect to the bow portion to apply a moment thereto when the contact arms are compressed and urged toward each other by the circuit boards thereby cause straightening of the bow portion, wherein the wall limits deflection of the bow portion.

18. A stacked arrangement of electrically interconnected circuits, comprising;

a connector housing, contacts carried by the connector housing, respective circuits at opposite sides of the connector housing in stacked relation and interconnected electrically with and via respective contacts, and wherein the contacts comprising leaf spring contacts having respective contact areas resiliently urged into connecting engagement with terminals of respective circuits and a flexible bowed portion in the connector housing deflecting in response to moments imparted thereto by movement of the contact areas compressed toward each other by the circuits engaged with the contact areas thereby causing straightening of the flexible bowed portion.

19. A method of electrically interconnecting a plurality of circuit boards in a stacked relation, comprising;

urging a pair of circuit boards toward opposite sides of a connector housing in a stacked relation therewith to compress contact areas of respective leaf spring contacts carried by the connector housing toward each other causing resilient engagement of the contact areas with respective terminals of the circuit boards while moment created by the resilient engagement is sustained by a portion of the contact in the connector housing.

wherein the urging causes leaf spring straightening.

20. A method of providing selective grounding and/or shielding in an interface connector including a planar conductive member in a connector housing, conductive tabs from the planar conductive member extending into respective openings in the connector housing, and deformable contacts in respective openings, comprising:

deforming at least one contact upon engagement with an external member intended to be connected to such contact so as to urge a portion of the contact into engagement with the conductive member thereby straightening the portion of the contact.

21. A feed-through connector system to interconnect stacked circuit boards arranged in an elongated form factor, comprising;

a connector housing having a perimeter for fitting within such form factor and a pair of substantially planar surface areas at opposite ends of the connector housing for confronting circuit boards in a stacked relation thereto, openings through the connector housing in alignment with terminal pads on respective circuit boards, and electrical contacts in the openings, the electrical contacts connecting terminal pads of one circuit board to terminal pads of another circuit board, wherein the electrical contacts include:

a spline in an opening of the connector housing, and a pair of contact arms extending from opposite ends of the spline and having respective contact areas ordinarily exposed from a respective opening beyond a respective planar surface of the connector housing when the contact arms are in free unconstrained relation, the contact areas of an electrical contact being compressed toward such planar surfaces and openings by engagement with terminal pads of respective circuit boards adjacent the connector housing, and wherein the spline includes a nonlinear portion that straightens as the spline moves toward engagement with a wall in the opening in response to movement caused by such compressing.

* * * * *